US011739969B2

(12) United States Patent
De' Longhi et al.

(10) Patent No.: US 11,739,969 B2
(45) Date of Patent: Aug. 29, 2023

(54) PORTABLE AIR CONDITIONER AND CONTROL METHOD

(71) Applicant: DE' LONGHI APPLIANCES S.R.L. CON UNICO SOCIO, Treviso (IT)

(72) Inventors: Giuseppe De' Longhi, Treviso (IT); Stefano Vit, Sesto Al Reghena (IT); Ivano Callegaro, Vedelago (IT)

(73) Assignee: DE' LONGHI APPLIANCES S.R.L. CON UNICO SOCIO, Treviso (IT)

( * ) Notice: Subject to any disclaimer, the term of this patent is extended or adjusted under 35 U.S.C. 154(b) by 213 days.

(21) Appl. No.: 16/650,838

(22) PCT Filed: Sep. 25, 2018

(86) PCT No.: PCT/IT2018/050176

§ 371 (c)(1),
(2) Date: Mar. 25, 2020

(87) PCT Pub. No.: WO2019/058408

PCT Pub. Date: Mar. 28, 2019

(65) Prior Publication Data

US 2020/0292195 A1 Sep. 17, 2020

(30) Foreign Application Priority Data

Sep. 25, 2017 (IT) ..... 102017000107190

(51) Int. Cl.
*F24F 11/65* (2018.01)
*F24F 5/00* (2006.01)

(52) U.S. Cl.
CPC ..... *F24F 11/65* (2018.01); *F24F 5/001* (2013.01)

(58) Field of Classification Search
CPC ..... F24F 11/871; F24F 12/003; F24F 3/147; F24F 5/001
See application file for complete search history.

(56) References Cited

U.S. PATENT DOCUMENTS

2010/0024106 A1* 2/2010 Katsumi ..... F24F 12/003 4/213

FOREIGN PATENT DOCUMENTS

| | | | |
|---|---|---|---|
| EP | 3 093 568 A1 | | 11/2016 |
| GB | 2528642 A | | 2/2016 |
| GB | 2542377 A | | 3/2017 |
| JP | S58142138 A | * | 8/1983 |
| JP | 2012-189265 A | | 10/2012 |

OTHER PUBLICATIONS

JPS58142138A Translation (Year: 1983).*
International Search Report and Written Opinion for PCT/IT2018/050176, dated Jan. 24, 2019.

* cited by examiner

*Primary Examiner* — Schyler S Sanks
(74) *Attorney, Agent, or Firm* — MARSHALL, GERSTEIN & BORUN LLP

(57) ABSTRACT

A portable conditioner to cool or heat an internal space separate from an external space includes a control and command unit configured to determine at least the enthalpy difference between the internal space and the external space, and to regulate the quantity of air exchanged with the external space in relation to the enthalpy difference determined with respect to an expected value of enthalpy difference corresponding to a conditioning temperature and to a defined conditioning relative humidity. The present invention also concerns a method to regulate the portable conditioner.

11 Claims, 3 Drawing Sheets

PORTABLE AIR CONDITIONER AND CONTROL METHOD

FIELD OF THE INVENTION

Embodiments of the present invention concern a portable conditioner which can be installed in an internal domestic space, such as a room, or another space other than the outside, and able to dynamically condition the environmental conditions thereof in relation to the needs of a user.

The present invention also concerns a regulation method able to dynamically condition the functioning of the conditioner in relation to the environmental conditions desired on each occasion by the user.

In the present description, including the claims, by portable or even "mobile" conditioners, we mean an appliance for homes, offices, communities and so on that can be moved from one place to another, but during functioning remains substantially stationary.

BACKGROUND OF THE INVENTION

Known portable conditioners normally comprise an internal exchanger and an external exchanger functionally connected to each other to cool or heat an internal space.

Depending on whether the portable conditioner is in cooling or heating mode, the internal exchanger and the external exchanger function respectively as an evaporator and a condenser, or vice versa.

By internal space we mean for example a room, or a space delimited with respect to an external space by means of walls, possibly provided with windows and/or doors.

Known portable conditioners can be installed in the internal space and can be differentiated according to how they are connected to the external space.

When the external exchanger has an air outlet pipe and an air inlet pipe, or two apertures, connected to the external space, the conditioner is the double pipe type.

On the contrary, when the external exchanger is connected to the external space solely by means of an outlet pipe or an aperture, the conditioner is the single-pipe type.

One or both of the pipes present between the external exchanger and the external space, both in the case of a single-pipe conditioner and also in the case of a double-pipe conditioner, can be provided with a delivery device and/or a suction device able to define the flow rate, and therefore the quantity, of air exchanged with the external space.

In relation to the quantity of air expelled into the external space, or the difference between the quantity of air expelled into the external space and the quantity of air taken in from the external space and entering the internal space, an imbalance can occur between the pressure of the internal space and the pressure of the external space.

This pressure imbalance induces a natural re-integration of air from the external to the internal space through doors, windows, or other apertures or interspaces that can possibly be present.

The quantity of air re-integrated normally has different characteristics from those of the internal space.

These differences weigh heavily on the functioning of the portable conditioner which has to deal with a greater heat load to be conditioned.

This results in a reduction in the real cooling or heating capacity of the conditioner which entails an intensification of the functioning of the conditioner with the consequent expenditure of high quantities of energy without however increasing the cooling or heating efficiency.

Some known solutions provide to measure the temperature and humidity values of both the external space and also the internal space, and to compare them in order to automatically adapt the energy supplied to the conditioner.

In order to adapt the energy supplied to the conditioner, a regulation method provides to supply more energy when the thermal load to be cooled or heated is greater than a predetermined threshold.

It is possible to adapt the energy of the portable conditioner only if the temperature of the external space is higher or lower than the indoor temperature respectively, if the conditioner is in cooling or heating mode, while in the opposite case the portable conditioner works normally.

This does not solve the problem of energy expenditure since in the first case, especially around the balanced condition, the energy supplied to the portable conditioner is regulated several times to maintain the internal space in the balanced condition.

In the second case too, for example when the conditioner is in cooling mode during the night hours, there is in any case a high energy expenditure because, although the re-integration of air promotes maintaining the temperature set by the user in the internal space in a natural way, the functioning of the portable conditioner remains substantially unchanged.

A conditioning system is known from GB 2542377, for the interior of a vehicle, which therefore operates mainly if not exclusively with the vehicle in motion. This document provides internal sensors to detect the temperature and air quality inside the vehicle, and external sensors to detect the temperature and air quality outside the vehicle. A control system is provided that regulates the inflow of air from outside to inside the vehicle to maintain the air quality inside the interior at a predetermined level.

There is therefore the need to perfect and make available a portable conditioner for domestic use, meaning both homes and offices, schools or communities in general, and a corresponding regulation method, which overcome at least one of the disadvantages of the state of the art and dynamically reduce energy use.

The purpose of the present invention is therefore to provide a portable conditioner which allows to optimize energy consumption and performance in relation to variations in environmental conditions between the internal space and the external space.

The purpose of the present invention is also to provide a method to regulate a portable conditioner able to optimize the energy consumption of the portable conditioner itself.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, the present invention concerns a portable conditioner for domestic use to condition spaces such as a room, that comprises an internal exchanger and an external exchanger functionally coordinated to cool and/or to heat an internal space separate from an external space.

Here and hereafter in the description, by separate spaces we mean spaces between which there are walls which define a room in which the portable conditioner can be installed, to take the space to, and keep it at, a conditioning temperature defined by a user on each occasion.

The walls can comprises one or more windows, doors, or other apertures or interspaces.

The internal exchanger is connected to the internal space and the external exchanger is connected to the external space by means of connection pipes configured to exchange air respectively with the internal space and with the external space.

In particular, in cooling mode the internal exchanger functions as an evaporator and the external exchanger functions as a condenser, while in heating mode the internal exchanger functions as condenser and the external exchanger functions as an evaporator.

At least one of the connection pipes of the external exchanger is provided with a delivery device and/or a suction device configured to define, on each occasion, a quantity of air which the external exchanger exchanges with the external space in order to maintain the internal space at a conditioning temperature predefined by the user, and a relative humidity predefined by the user.

In accordance with one aspect of the present invention, the portable conditioner comprises a control and command unit configured to command at least the delivery device and/or the suction device to regulate on each occasion the quantity of air supplied to the external space in relation to the enthalpy difference between the two spaces.

According to possible embodiments, the control and command unit is configured to receive and send control signals and data measured and/or processed by means of a remote communication system chosen from a group comprising Wi-Fi, internet, Near Field Communication (NFC), wireless, Bluetooth, infrared or other.

The quantity of air supplied to the external space can be regulated by varying the flow of air exiting from the delivery device and/or entering from the suction device in relation to the conditioning temperature and to the relative humidity defined as set-point values by the user, so that the flows of air exchanged between the external space and the internal space lead to the establishment of the values of conditioning temperature and conditioning relative humidity set by the user in the internal space.

According to one aspect of the present invention, when the air conditioner is in cooling mode, the control and command unit is able to command at least the delivery device and/or the suction device to reduce the quantity of air supplied to the external space if the temperature of the external space is higher than the conditioning temperature and to increase the quantity of air supplied to the external space if the temperature of the external space is lower than the conditioning temperature.

In a substantially similar manner, in cooling mode the control and command unit is able to reduce the quantity of air supplied to the external space if the relative humidity of the external space is higher than the conditioning relative humidity of the space, and to increase the quantity of air supplied to the external space if the relative humidity of the external space is lower than the conditioning relative humidity of the space.

In fact, considering the case where the portable conditioner is in cooling mode, if the relative humidity of the external space is lower than the conditioning relative humidity of the space, the control and command unit detects this condition and exploits the contribution due to the natural re-integration of air from the external space to the internal space induced by the pressure imbalance, promoting it by increasing the exchange flow of air exchanged.

According to one aspect of the present invention, when the conditioner is in heating mode, the control and command unit is able to command at least the delivery device and/or the suction device to reduce the quantity of air supplied to the external space if the temperature of the external space is lower than the conditioning temperature, and to increase the quantity of air supplied to the external space if the temperature of the external space is higher than the conditioning temperature.

Similarly, when the conditioner is in heating mode, the control and command unit is able to command at least the delivery device and/or the suction device to reduce the quantity of air supplied to the external space if the relative humidity of the external space is lower than the conditioning relative humidity, and to increase the quantity of air supplied to the external space if the relative humidity of the external space is higher than the conditioning relative humidity.

This solution allows to optimize energy consumption if the conditioner is in cooling mode and if the conditioner is in heating mode, managing the functioning of the portable conditioner in a dynamic and weighted manner in relation to the specific environmental conditions.

This is obtained by promoting or hindering the natural re-integration of air due to the pressure imbalance between the internal space and the external space.

According to possible solutions, the control and command unit is configured to command the delivery device and/or the suction device if the enthalpy difference determined is different from an expected value corresponding to the conditioning temperature and to the conditioning relative humidity for a longer time than a defined threshold time.

According to possible solutions, the control and command unit is configured to command the delivery device and/or the suction device if the temperature and/or the relative humidity of the external space is different from the conditioning temperature and/or from the conditioning relative humidity for a longer time than a defined threshold time.

In this case too, it is not necessary to drive the delivery device and/or the suction device in cases where there is a temporary variation in temperature, and for a limited time.

Formulations of the present invention also concern a method to regulate a portable conditioner that provides at least to:

acquire the values of temperature and humidity of the internal space and the external space;

calculate an expected value of enthalpy difference in relation to the desired and pre-determined conditioning temperature and relative humidity;

determine at least the enthalpy difference between the internal space and the external space;

command at least the delivery device and/or the suction device to regulate the quantity of air exchanged with the external space in relation to the enthalpy difference determined with respect to an expected value of enthalpy difference corresponding to the desired conditioning temperature and relative humidity in the internal space.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
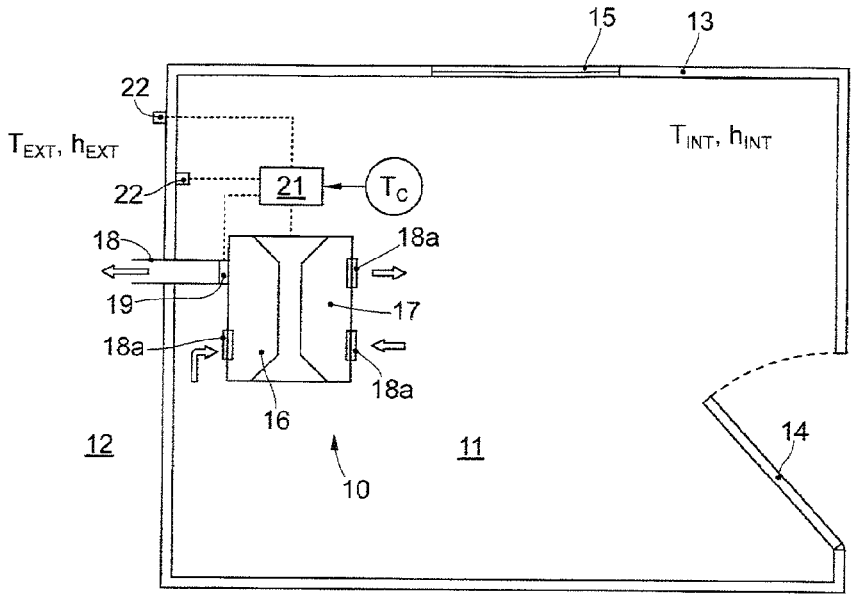
FIG. 1 is a schematic view of a portable conditioner of the type with a single pipe installed in an internal space according to a possible embodiment of the present invention.
Figure 2:
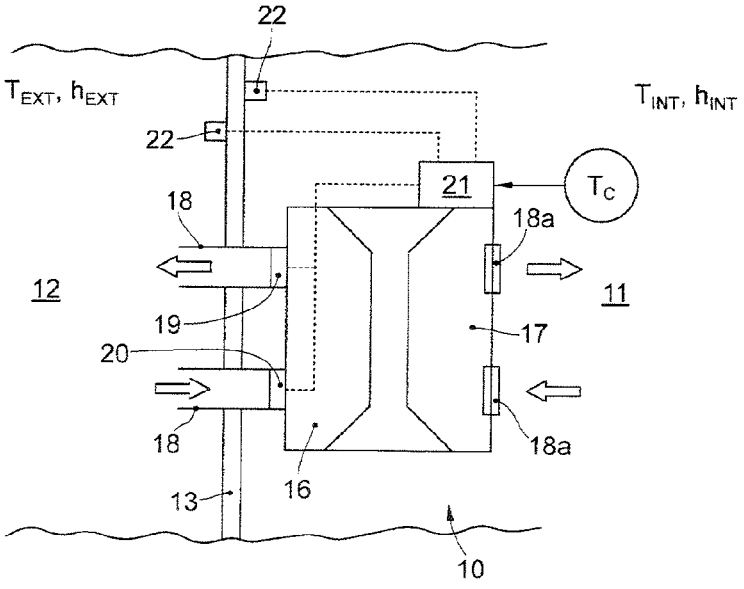
FIG. 2 is a schematic view of a portable conditioner of the type with a double pipe installed in an internal space according to a possible embodiment of the present invention.
Figure 3:
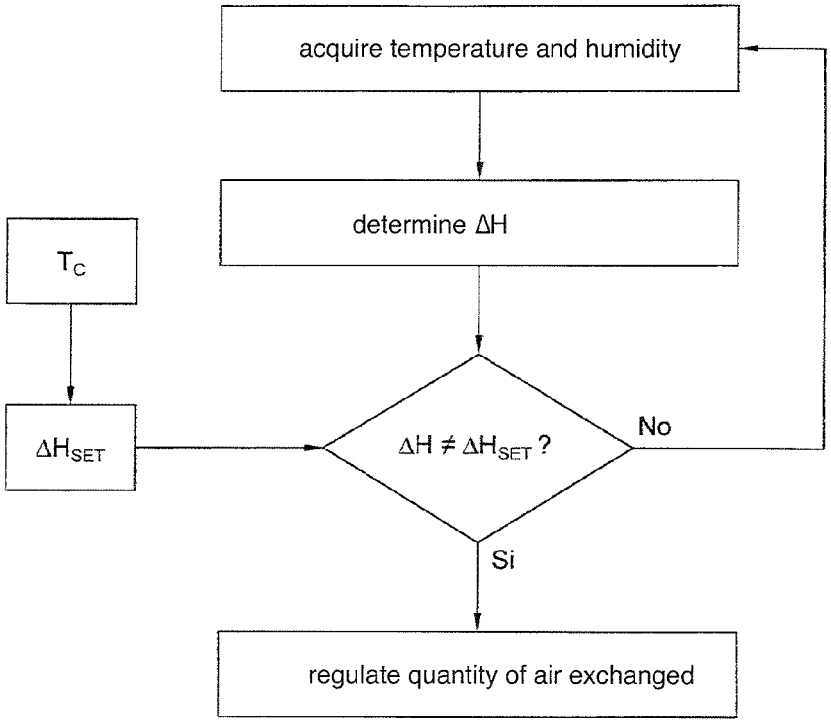
FIG. 3 is a block diagram of the method to regulate a portable conditioner according to possible embodiments of the present invention.
Figure 4:
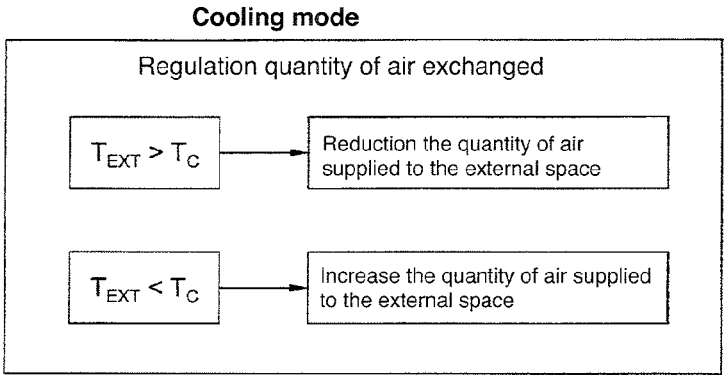
FIGS. 4 and 5 are two block diagrams of the method to regulate a portable conditioner in cooling mode and heating mode according to possible embodiments of the present invention.
Figure 5:
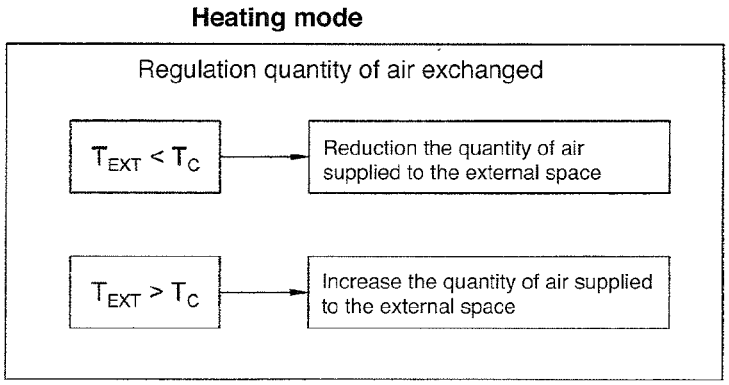

Embodiments described here with reference to FIGS. 1 and 2 concern a portable conditioner 10 which can be installed in an internal space 11, distinct from an external space 12, and able to condition the environmental conditions of the internal space 11 on each occasion.

In particular, the portable conditioner 10 is configured to cool or heat the internal space 11 so as to bring it to and keep it at a defined conditioning temperature Tc and a conditioning relative humidity RHc %. The conditioning temperature Tc and relative humidity RHc % can be defined on each occasion by the user as set-point values set by the user to regulate the functioning of the portable conditioner 10.

The internal space 11 can be defined by a plurality of walls 13 along which there can be doors 14 and/or windows 15.

The internal space 11 and the external space 12 are characterized by respective temperature values Text and Tint and humidity hext and hint.

The portable conditioner 10 comprises an external exchanger 16 and an internal exchanger 17 functionally coordinated to cool or heat the internal space 11.

Here and hereafter in the description, by way of non-restrictive example, reference will be made to the case where the portable conditioner 10 is in cooling mode.

It is clear that the aspects relating to the portable conditioner 10 in cooling mode are also valid if the portable conditioner 10 is in heating mode, taking into account that at least the conditions on the temperature values with respect to the conditioning temperature Tc and relative humidity RH % are inverted.

By functionally coordinated we mean that they carry out the steps of conditioning the air present in the internal space 11 in a coordinated manner, suitably exchanging heat with the external space 12, to reach and maintain the conditioning temperature Tc and the conditioning relative humidity RHc % in the internal space 11.

If the portable conditioner 10 is in cooling mode, the internal exchanger 17 functions as an evaporator, while the external exchanger 16 functions as a condenser.

The internal exchanger 17 is connected to the internal space 11 and the external exchanger 16 is connected to the external space 12 by connection pipes 18 configured to fluidically connect the portable conditioner 10 with the internal space 11 and the external space 12, respectively.

In other words, the connection pipes 18 allow to exchange air with the internal space 11 and with the external space 12.

FIG. 1 shows the case where the external exchanger 16 is connected by a single connection pipe 18 to the external space 12. The other connection pipes 18 represented as apertures 18*a* connect the portable conditioner 10 to the internal space 11. This configuration defines a portable conditioner 10 of the single pipe type.

FIG. 2 shows the case of a portable conditioner 10 of the double pipe type, in which the external exchanger 16 is connected with two connection pipes 18, one to supply air to the external space 12 and the other to collect air from the latter.

At least one of the connection pipes 18 of the external exchanger 16 is provided with a delivery device 19 and/or a suction device 20 configured to define, on each occasion, a quantity of air that the external exchanger 16 exchanges with the external space 12 to maintain the internal space 11 at the conditioning temperature Tc and at the relative humidity RHc % predefined by the user.

The delivery device 19 can comprise, for example, a delivery fan, a flow regulator or other forced delivery nozzle which can be controlled, for example, with an electromechanical actuator.

The suction device 20 can comprise, for example, an aspirator, a flow regulator or other forced suction nozzle which can be controlled for example with an electromechanical actuator.

In both cases shown in FIGS. 1 and 2, during use, the portable conditioner 10 creates a pressure imbalance between the internal space 11 and the external space 12.

This pressure imbalance induces a natural re-integration of air from the external space 12 to the internal space 11 through the doors 14 and/or the windows 15, or other apertures or interspaces possibly present in the walls 13.

According to one aspect of the present invention, the portable conditioner 10 comprises a control and command unit 21 configured to determine at least the enthalpy difference ΔH between the internal space 11 and the external space 12.

This determination is carried out by the control and command unit 21 using at least the temperature values Text and Tint and humidity values hext and hint of the internal space 11 and the external space 12.

The temperature and humidity values can be acquired by means of suitable sensors 22.

The sensors 22 can be removably installed on a wall 13 or in another zone of the internal space 11 and the external space 12.

The sensors 22 can comprise temperature sensors, humidity sensors, combined sensors, or other sensors able to measure other physical quantities of the external space 12 and the internal space 11.

The control and command unit 21 is configured to control at least the delivery device 19 and/or the suction device 20 so as to regulate, on each occasion, the quantity of air exchanged with the external space 12 in relation to the enthalpy difference ΔH determined with respect to an expected enthalpy difference value ΔHset corresponding to the conditioning temperature Tc and to the conditioning relative humidity RHc % set by the user.

This solution allows to dynamically regulate the quantity of air exchanged with the external space 12, so as to adapt the energy consumption and the performance of the portable conditioner 10 in relation to any variations with respect to the conditions sought or expected.

According to possible embodiments, the control and command unit 21 can be integrated with the portable conditioner 10, or it can be connected to the latter remotely.

For example, the connection between the control and command unit 21 and the portable conditioner 10 or its components can be obtained by using a Wi-Fi connection, infrared, remote communication systems, or near field communication (NFC), or other.

By way of example, the control and command unit 21 can comprise a microcontroller, an electronic circuit, a processor, or other electronic units functionally connected to each other to perform, on each occasion, the specific functions performed by the control unit and command 21.

The control and command unit 21 can be configured to regulate the delivery speed of the desired quantity of air from the external exchanger 16 to the external space 12.

The control and command unit 21 can be configured to regulate the suction speed of the desired quantity of air from the external space 12 to the external exchanger 16.

According to possible embodiments, the control and command unit 21 can be connected by cable, or remotely, to the delivery device 19 and/or to the suction device 20 and can regulate its functioning, for example by acting on the electromechanical actuator possibly present.

The control and command unit 21 is configured to continuously receive the values of temperature and humidity acquired on each occasion by, for example, the sensors 22, or by detection stations, and then process them, so as to obtain the instantaneous enthalpy values of the internal space 11 and the external space 12.

According to possible embodiments, the control and command unit 21 is configured to reduce the quantity of air supplied to the external space 12 if the temperature Text of the external space 12 is higher than the conditioning temperature Tc and to increase the quantity of air supplied to the external space 12 if the temperature Text of the external space 12 is lower than the conditioning temperature Tc.

Considering the case where the portable conditioner 10 is in cooling mode, if the external temperature Text is lower than the conditioning temperature Tc, the control and command unit 21 detects this condition and exploits the contribution due to the natural re-integration of air from the external space 12 to the internal space 11 induced by the pressure imbalance, promoting it by increasing the flow of air exchanged.

According to possible embodiments, the control and command unit 21 is also configured to reduce the quantity of air supplied to the external space 12 if the relative humidity RH % of the external space 12 is higher than the conditioning relative humidity RHc % of the internal space 11, and to increase the quantity of air supplied to the external space 12 if the relative humidity RH % of the external space 12 is lower than the desired conditioning relative humidity RHc % of the internal space 11.

Considering the case where the portable conditioner 10 is in cooling mode, if the relative humidity RH % of the external space 12 is lower than the conditioning relative humidity RHc % of the internal space 11, the control and command unit 21 detects this condition and exploits the contribution due to the natural re-integration of air from the external space 12 to the internal space 11 induced by the pressure imbalance, promoting it by increasing the flow of air exchanged.

In fact, by increasing the quantity of air supplied to the external space 12, the pressure imbalance increases, or at least remains constant, and therefore also the re-integration of air increases or remains constant.

The circulation of air from the external space 12 to the internal space 11 having a lower temperature than the internal one promotes the lowering of the temperature of the internal space 11 and therefore accelerates the action of the portable conditioner 10 which reduces the power used in a shorter time.

By promoting the natural action of the re-integrated air having a lower temperature than the conditioning temperature Tc, it saves the energy of the portable conditioner 10 and at the same time increases its real efficiency.

If the external temperature Text is higher than the conditioning temperature Tc, the control and command unit 21 detects this condition and counteracts its effects by trying to minimize, or if necessary, to cancel, the re-integration of air which increases the thermal load of the internal space 11.

In a substantially similar manner, this also occurs when the outside relative humidity RH % is higher than the conditioning relative humidity RHc %, in which the re-integration of air between outside and inside is reduced in the same way.

According to possible embodiments, the control and command unit 21 is configured to command the delivery device 19 and/or the suction device 20 when the enthalpy difference ΔH determined is different from the expected enthalpy difference value ΔHset for a time longer than a defined threshold time.

This characteristic allows to drive the delivery device 19 and/or the suction device 20 exclusively in those cases where the enthalpy difference ΔH remains different for a long enough time from the expected enthalpy difference ΔHset to exclude the cases where there are re-integrations of the air, or other temporary phenomena such as for example the opening of a door 14 and/or a window 15.

This considerably reduces the repeated power variations to which the delivery device 19 and/or the suction device 20 can be subjected, which also entails a considerable energy saving.

According to possible solutions, the control and command unit 21 is configured to command the delivery device 19 and/or the suction device 20 if the temperature Text of the external space 12 is different from the conditioning temperature Tc for a time longer than a defined threshold time.

In this case too, it is not necessary to drive the delivery device 19 and/or the suction device 20 if there is a temporary variation, for a limited time, in the temperature.

Formulations of the present invention also concern a method to regulate a portable conditioner 10 which provides at least:

- to acquire, by means of suitable sensors 22, the temperature and humidity values of the internal space 11 and the external space 12;
- to determine at least the enthalpy difference ΔH between the internal space 11 and the external space 12;
- to command at least the delivery device 19 and/or the suction device 20 in order to regulate the quantity of air exchanged with the external space 12 in relation to the enthalpy difference ΔH determined with respect to an expected enthalpy difference value ΔHset corresponding to the conditioning temperature Tc and the conditioning relative humidity RHc %.

According to possible embodiments, when the portable conditioner 10 is in cooling mode, the regulation method provides to command at least the delivery device 19 and/or the suction device 20 to reduce the quantity of air supplied to the external space 12 if the temperature Text of the external space 12 is higher than the conditioning temperature Tc and to increase the quantity of air supplied to the external space 12 if the temperature Text of the external space 12 is lower than the conditioning temperature Tc.

Furthermore, in cooling mode the regulation method provides to reduce the quantity of air supplied to the external space 12 if the relative humidity RH % of the external space 12 is higher than the conditioning relative humidity RHc % of the internal space 11, and to increase the quantity of air supplied to the external space 12 if the relative humidity RH % of the external space 12 is less than the desired conditioning relative humidity RHc % of the internal space 11.

According to possible embodiments, when the portable conditioner 10 is in heating mode, the regulation method provides to command at least the delivery device 19 and/or the suction device 20 to reduce the quantity of air supplied to the external space 12 if the temperature Text of the external space 12 is lower than the conditioning temperature Tc and to increase the quantity of air supplied to the external space 12 if the temperature Text of the external space 12 is higher than the conditioning temperature Tc.

In a similar way, in heating mode, the regulation method provides to reduce the quantity of air supplied to the external space 12 if the relative humidity RH % of the external space 12 is less than the conditioning relative humidity RHc % and to increase the quantity of air supplied to the external space 12 if the relative humidity RH % of the external space 12 is higher than the conditioning relative humidity RHc %.

In accordance with possible embodiments, the regulation method provides to command the delivery device 19 and/or the suction device 20 if the enthalpy difference ΔH determined is different from an expected enthalpy difference value ΔHset for a time longer than a defined threshold time.

According to possible embodiments, the regulation method provides to command the delivery device 19 and/or the suction device 20 if the acquired temperature Text of the external space 12 is different from the conditioning temperature Tc for a time longer than a defined threshold time.

In accordance with possible embodiments, the regulation method provides to command the delivery device 19 and/or the suction device 20 proportionally to the deviation of the determinate enthalpy difference ΔH with respect to the expected enthalpy difference value ΔHset.

According to possible embodiments, the regulation method provides to command the delivery device 19 and/or the suction device 20 proportionally to the deviation of the acquired temperature Text of the external space 12 with respect to the conditioning temperature Tc.

It is clear that modifications and/or additions of parts can be made to the portable conditioner 10 and to the regulation method as described heretofore, without departing from the field and scope of the present invention.

It is also clear that, although the present invention has been described with reference to some specific examples, a person of skill in the art shall certainly be able to achieve many other equivalent forms of portable conditioner 10 and the method to regulate it, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A single pipe or double pipe portable conditioner for domestic use to condition spaces, comprising: an external exchanger and an internal exchanger functionally coordinated to cool or to heat an internal space separate from an external space, wherein the internal exchanger is connected to said internal space and said external exchanger is connected to said external space by connection pipes configured to exchange air respectively with said internal space and with said external space, wherein when in a cooling mode the internal exchanger functions as an evaporator and the external exchanger functions as a condenser, and when in a heating mode the internal exchanger functions as the condenser and the external exchanger functions as the evaporator, at least one connection pipe of said external exchanger being provided with a delivery device and/or a suction device able to define a quantity of air exchanged with said external space in order to maintain said internal space at a conditioning temperature and at a conditioning relative humidity predefined by a user, and further comprising a control and command unit configured to determine an enthalpy difference between said internal space and said external space using values of temperature and of humidity of said internal space and said external space, and the control and command unit arranged to command said delivery device and/or said suction device to regulate said quantity of air exchanged with said external space in relation to said enthalpy difference determined with respect to an expected value of enthalpy difference corresponding to said conditioning temperature and to said conditioning relative humidity, and further wherein said control and command unit is configured to command said delivery device and/or said suction device if said acquired temperature and said relative humidity of said external space is different from said conditioning temperature (Tc) and from said conditioning relative humidity for a longer time than a defined threshold time.

2. The portable conditioner as in claim 1, wherein said control and command unit is configured to reduce said quantity of air supplied to said external space if the temperature of said external space is higher or lower than said conditioning temperature and to increase said quantity of air supplied to said external space if the temperature of said external space is lower or higher than said conditioning temperature, respectively if the cooling mode or the heating mode is active.

3. The portable conditioner as in claim 1, wherein said control and command unit is configured to reduce said quantity of air supplied to said external space if the relative humidity of said external space is higher or lower than said conditioning relative humidity, and to increase said quantity of air supplied to said external space if the relative humidity of said external space is lower or higher than said conditioning relative humidity, respectively if the cooling mode or the heating mode is active.

4. The portable conditioner as in claim 1, wherein said control and command unit is configured to receive and send control signals and data measured and/or processed by means of a remote communication system chosen from a group comprising Wi-Fi, internet, Near Field Communication, wireless, Bluetooth and infrared.

5. A method to regulate a portable conditioner for domestic use to condition spaces, comprising: an external exchanger and an internal exchanger functionally coordinated to cool or to heat an internal space separate from an external space, in which said internal exchanger is connected to said internal space and said external exchanger is connected to said external space by means of connection pipes configured to exchange air respectively with said internal space and with said external space, at least one connection pipe of said external exchanger being provided with a delivery device and/or a suction device configured to define, on each occasion, a first quantity of air exchanged with said external space in order to maintain said internal space at a conditioning temperature and at a conditioning relative humidity predefined by a user, wherein said method further comprises:

acquiring values of temperature and of humidity of said internal space and said external space;

calculating an expected value of enthalpy difference corresponding to said conditioning temperature and to said conditioning relative humidity;

determining at least the enthalpy difference between said internal space and said external space;

determining at least said delivery device and/or said suction device to regulate said first quantity of air exchanged with said external space in relation to said enthalpy difference determined with respect to said expected value of enthalpy difference; and wherein, during use, creating a pressure imbalance between the external space and the internal space;

using the delivery device and/or the suction device to regulate a second quantity of air supplied to the external space thereby promoting or hindering a re-integration of air due the pressure imbalance between the internal space and the external space; and configuring said control and command unit to command said delivery device and/or said suction device if said acquired temperature and said relative humidity of said external space is different from said conditioning temperature (Tc) and from said conditioning relative humidity for a longer time than a defined threshold time.

6. The method as in claim 5, including commanding at least said delivery device and/or said suction device to reduce said quantity of air supplied to said external space if the temperature of said external space is higher or lower than said conditioning temperature, and to increase said first quantity of air supplied to said external space if the temperature of said external space is lower or higher than said conditioning temperature, respectively if the cooling mode or the heating mode is active.

7. The method as in claim 5, including commanding at least said delivery device and/or said suction device in order to reduce said first quantity of air supplied to said external space if the relative humidity of said external space is higher or lower than said conditioning relative humidity, and to increase said first quantity of air supplied to said external space if the relative humidity of said external space is lower or higher than said conditioning relative humidity, respectively if the cooling mode or the heating mode is active.

8. The method as in claim 5, including commanding at least said delivery device and/or said suction device if said enthalpy difference determined is different from said expected value of enthalpy difference for a longer time than a defined threshold time.

9. The method as in claim 5, including commanding said delivery device and/or said suction device if said acquired temperature and said acquired relative humidity of said external space is different from said conditioning temperature (Tc) and from said conditioning relative humidity for a longer time than a defined threshold time.

10. The method as in claim 5, including commanding said delivery device and/or said suction device proportionally to the deviation of said enthalpy difference determined with respect to said expected value of enthalpy difference.

11. The method as in claim 5, including commanding said delivery device and/or said suction device proportionally to the deviation of said acquired temperature of said external space with respect to said conditioning temperature.

* * * * *